US009474381B2

(12) United States Patent
Brandtner et al.

(10) Patent No.: US 9,474,381 B2
(45) **Date of Patent: *Oct. 25, 2016**

(54) FURNITURE ASSEMBLY SYSTEM

(71) Applicant: Ashley Furniture Industries, Inc., Arcadia, WI (US)

(72) Inventors: Timothy A. Brandtner, Etrick, WI (US); Peter J. Fynboh, Saint Charles, MN (US); Christopher Jon Lejcher, Blair, WI (US)

(73) Assignee: ASHLEY FURNITURE INDUSTRIES, INC., Arcadia, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/331,595

(22) Filed: Jul. 15, 2014

(65) Prior Publication Data

US 2015/0130253 A1 May 14, 2015

Related U.S. Application Data

(63) Continuation of application No. 13/304,172, filed on Nov. 23, 2011, now Pat. No. 8,777,319.

(60) Provisional application No. 61/469,332, filed on Mar. 30, 2011, provisional application No. 61/515,677, filed on Aug. 5, 2011.

(51) Int. Cl.

| | |
|---|---|
| ***A47C 17/02*** | (2006.01) |
| ***A47C 4/02*** | (2006.01) |
| ***A47C 17/86*** | (2006.01) |

(52) U.S. Cl.

CPC ..... *A47C 17/02* (2013.01); *A47C 4/02* (2013.01); *A47C 4/028* (2013.01); *A47C 17/86* (2013.01); *Y10T 29/481* (2015.01); *Y10T 29/49963* (2015.01)

(58) Field of Classification Search

CPC ..... A47C 17/02; A47C 17/86; A47C 4/02; A47C 4/028

USPC ..... 411/337, 354, 367, 406, 401; 403/360, 403/381, DIG. 13, DIG. 12, 44; 297/440.11, 297/440.1, 218.3; 29/525.02

See application file for complete search history.

(56) References Cited

U.S. PATENT DOCUMENTS

| | | | |
|---|---|---|---|
| 276,135 | A | 4/1883 | Cooley |
| 2,466,204 | A | 4/1949 | Brown |

(Continued)

FOREIGN PATENT DOCUMENTS

| | | | |
|---|---|---|---|
| CN | 2606552 | Y | 3/2004 |

OTHER PUBLICATIONS

Application and File History of U.S. Appl. No. 13/304,199, filed Nov. 23, 2011, titled "Sofa with Seat Stretcher", Inventors Lejcher et al.

(Continued)

*Primary Examiner* — Milton Nelson, Jr.
(74) *Attorney, Agent, or Firm* — Christensen Fonder P.A.

(57) ABSTRACT

An assembly system permitting separate construction and transport of subcomponents for seating furniture items. The disassembled subcomponents allow for more efficient transportation by eliminating the dead space created by transporting irregularly shaped assembled furniture items. The assembly system includes a seat box having a rectangular frame defining an accessible internal cavity covered by an upper support surface. The assembly system also comprises a back rest having a seat box interface surface and at least arm rest interface surface. The back rest also defines an internal cavity accessible through closable opening for internal access to the arm rest interface surfaces. The assembly system also includes mounting an interface surface to the arm rest for securing the arm rest to the arm rest interface surface of the back rest and the rectangular frame of the seat box.

18 Claims, 8 Drawing Sheets

(56) References Cited

U.S. PATENT DOCUMENTS

| | | | | |
|---|---|---|---|---|
| 2,644,510 | A * | 7/1953 | Benmax | 5/402 |
| 2,660,228 | A | 11/1953 | Reinhold | |
| 2,703,136 | A | 3/1955 | Masse | |
| 2,732,889 | A | 1/1956 | Healey | |
| 3,001,822 | A | 9/1961 | Pagliaro et al. | |
| 3,030,146 | A | 4/1962 | Faxon | |
| 3,066,982 | A | 12/1962 | Brower | |
| 3,104,913 | A | 9/1963 | Faulkner et al. | |
| 3,183,036 | A | 5/1965 | Hill | |
| 3,302,841 | A | 2/1967 | Beck | |
| 3,608,959 | A | 9/1971 | Sarvas | |
| 3,669,495 | A | 6/1972 | Von Rudgisch | |
| 4,077,517 | A | 3/1978 | Hilemn | |
| 4,140,065 | A | 2/1979 | Chacon | |
| 4,621,381 | A | 11/1986 | Schramek | |
| 4,832,421 | A | 5/1989 | Shoffner | |
| 4,869,564 | A | 9/1989 | Lechman | |
| 4,881,779 | A | 11/1989 | Bubien | |
| 4,909,581 | A | 3/1990 | Haheeb | |
| 4,926,759 | A * | 5/1990 | Vitsky et al. | 108/180 |
| 4,944,627 | A | 7/1990 | Durney | |
| 5,063,982 | A | 11/1991 | Durney | |
| 5,080,438 | A * | 1/1992 | Moyer | 297/440.23 |
| 5,088,180 | A | 2/1992 | Nottingham et al. | |
| 5,275,465 | A * | 1/1994 | Gulliver et al. | 297/173 |
| 5,332,289 | A | 7/1994 | Nottingham et al. | |
| 5,338,095 | A | 8/1994 | Laughlin et al. | |
| 5,454,331 | A | 10/1995 | Green | |
| 5,457,867 | A | 10/1995 | Maberry et al. | |
| 5,480,273 | A | 1/1996 | Jou | |
| 5,499,886 | A | 3/1996 | Short et al. | |
| 5,533,788 | A | 7/1996 | Nottingham et al. | |
| 5,551,757 | A | 9/1996 | Glover | |
| 5,590,975 | A | 1/1997 | Horntvedt | |
| 5,601,340 | A | 2/1997 | Stout | |
| 5,671,985 | A | 9/1997 | Grieser et al. | |
| 5,678,897 | A | 10/1997 | Prestia | |
| 5,738,414 | A | 4/1998 | Wieland et al. | |
| 5,743,670 | A | 4/1998 | Ader | |
| 5,775,778 | A | 7/1998 | Riley et al. | |
| 5,890,767 | A | 4/1999 | Chang | |
| 6,009,816 | A | 1/2000 | Wendel | |
| 6,055,912 | A | 5/2000 | Doud et al. | |
| 6,161,705 | A | 12/2000 | Riga et al. | |
| 6,168,031 | B1 | 1/2001 | Schmidt | |
| 6,220,187 | B1 | 4/2001 | Grosser | |
| 6,241,317 | B1 | 6/2001 | Wu | |
| 6,267,446 | B1 | 7/2001 | Wieland et al. | |
| 6,299,397 | B1 | 10/2001 | Mengel | |
| 6,474,901 | B1 | 11/2002 | Thurston | |
| 6,568,058 | B1 | 5/2003 | Wieland et al. | |
| 6,688,699 | B1 | 2/2004 | Bowie | |
| 6,692,079 | B2 | 2/2004 | Guillot | |
| 6,839,950 | B2 | 1/2005 | Guillot | |
| 6,942,298 | B2 | 9/2005 | Harrison | |
| 6,981,747 | B2 | 1/2006 | Wieland et al. | |
| 7,044,557 | B2 | 5/2006 | Wieland | |
| 7,168,766 | B2 | 1/2007 | Pelletier | |
| 7,207,757 | B2 | 4/2007 | Mengel | |
| 7,252,273 | B2 | 8/2007 | Lewellen et al. | |
| 7,252,339 | B2 | 8/2007 | Owens | |
| 7,300,111 | B2 | 11/2007 | Huang | |
| 7,387,344 | B2 | 6/2008 | Yu | |
| 7,419,220 | B2 | 9/2008 | White, III. et al. | |
| 7,434,304 | B2 | 10/2008 | Owens | |
| 7,445,279 | B2 | 11/2008 | Crum | |
| 7,523,989 | B2 | 4/2009 | Wieland et al. | |
| 7,547,073 | B2 | 6/2009 | White, III et al. | |
| 7,744,161 | B2 | 6/2010 | Berg et al. | |
| 7,744,162 | B2 | 6/2010 | Griggs, Jr. | |
| 7,922,253 | B2 | 4/2011 | Chen | |
| 8,322,793 | B2 | 12/2012 | Chen | |
| 8,356,954 | B2 * | 1/2013 | Koch | 403/353 |
| 8,777,319 | B2 | 7/2014 | Brandtner et al. | |
| 2002/0093235 | A1 | 7/2002 | Niederman et al. | |
| 2003/0011231 | A1 | 1/2003 | Guillot | |
| 2003/0151292 | A1 | 8/2003 | McLarty et al. | |
| 2003/0155847 | A1 | 8/2003 | Henkel | |
| 2003/0173814 | A1 | 9/2003 | Wieland et al. | |
| 2003/0193230 | A1 | 10/2003 | Guillot | |
| 2003/0222545 | A1 | 12/2003 | Stravitz | |
| 2003/0223840 | A1 | 12/2003 | Mengel | |
| 2004/0140706 | A1 | 7/2004 | Harrison | |
| 2005/0006943 | A1 | 1/2005 | Wieland | |
| 2005/0052068 | A1 | 3/2005 | Smith et al. | |
| 2005/0067876 | A1 | 3/2005 | Dortch | |
| 2005/0179303 | A1 | 8/2005 | Owens et al. | |
| 2005/0225153 | A1 | 10/2005 | Ou | |
| 2005/0263214 | A1 | 12/2005 | Durney | |
| 2006/0061191 | A1 | 3/2006 | Pelletier | |
| 2007/0011859 | A1 | 1/2007 | Owens et al. | |
| 2007/0063118 | A1 | 3/2007 | Owens et al. | |
| 2008/0111402 | A1 | 5/2008 | Crum | |
| 2008/0185897 | A1 | 8/2008 | Griggs | |
| 2008/0191538 | A1 | 8/2008 | Berg et al. | |
| 2008/0245277 | A1 | 10/2008 | Willy et al. | |
| 2008/0245281 | A1 | 10/2008 | Willy | |
| 2008/0252130 | A1 | 10/2008 | Wieland et al. | |
| 2009/0080969 | A1 | 3/2009 | Ho | |
| 2009/0123222 | A1 | 5/2009 | Ho | |
| 2009/0256456 | A1 | 10/2009 | Ho | |
| 2009/0309464 | A1 | 12/2009 | Schwartz | |
| 2010/0064947 | A1 | 3/2010 | Bettinger | |
| 2010/0254757 | A1 | 10/2010 | Saul | |
| 2010/0264715 | A1 | 10/2010 | Griggs, Jr. | |
| 2010/0270844 | A1 | 10/2010 | Hood | |
| 2010/0283363 | A1 | 11/2010 | Weitz et al. | |
| 2010/0310310 | A1 | 12/2010 | Hazzard | |
| 2012/0019038 | A1 * | 1/2012 | Mezzera | 297/440.15 |
| 2012/0080910 | A1 | 4/2012 | Davis | |
| 2012/0248842 | A1 | 10/2012 | Brandtner et al. | |

OTHER PUBLICATIONS

CN Search Report; Counterpart CN Application No. 201210146865.X; Filing Date: Mar. 30, 2012; 2 pages.

* cited by examiner

FURNITURE ASSEMBLY SYSTEM

PRIORITY CLAIM

This application is a continuation of U.S. patent application Ser. No. 13/304,172, filed Nov. 23, 2011, now U.S. Pat. No. 8,777,319 issued on Jul. 15, 2014, and entitled "FURNITURE ASSEMBLY SYSTEM", which application claims the benefit of U.S. Provisional Application No. 61/469,332 filed Mar. 30, 2011, and entitled "FURNITURE ASSEMBLY SYSTEM", and U.S. Provisional Application No. 61/515,677 filed Aug. 5, 2011, and entitled "FURNITURE ASSEMBLY SYSTEM", which applications are hereby incorporated by reference in their entirety.

FIELD OF THE DISCLOSURE

The present invention is directed to a ready to assembly furniture item and related method of assembling. Specifically, the present invention is directed to a ready to assemble furniture item that can transported as a plurality subcomponents and assembled without tools.

BACKGROUND OF THE INVENTION

Furniture items used for seating commonly comprise a support structure covered by upholstery and/or cushioning. In particular, sofas typically comprise a seat base, a back rest and at least one arm rest. A common aesthetic and practical design consideration is assembling the sofa to minimize the visible gaps between the subcomponents. Typically, the furniture item is fully assembled at the factory to insure the individual subcomponents are properly assembled and upholstered to minimize the appearance of visible gaps in the assembled furniture item.

The inherent drawback of assembling the furniture item at the factory is that the shape of the assembled furniture item typically prevents efficient packing of the furniture items for transport. Depending on the shape and size of the furniture item, the packing of the furniture item can result in a significant amount of dead space within the shipping container or truck. In addition to increasing the cost of transportation, the dead space can allow the furniture items to shift during transport resulting in safety risks or damage to the furniture item. Similarly, assembled furniture items can be awkwardly shaped and difficult to navigate into the home or other structure without significant positioning and reorienting of the furniture item. The awkward maneuvering and positioning of the furniture item required to move the furniture item into the structure can result in injury to the movers and/or damage to the furniture or the structure.

An approach to addressing the drawbacks of factory assembled furniture items comprises providing individually upholstered subcomponents as a ready to assemble ("RTA") furniture kit. The individual components can be more efficiently packed and allows the furniture item to be assembled in situ eliminating the need for navigating the furniture item through the building. However, the inherent challenge of providing RTA furniture kits is that the consumers who assemble the furniture kits are typically untrained and may not have ready access to the tools necessary to assemble the subcomponents. In addition, aligning the heavy subcomponents to install the fasteners for connecting the subcomponents can be difficult, particularly if a single individual is assembling the furniture item. If the fasteners are not properly installed the structural integrity of the furniture item could be compromised resulting in collapse and/or injury of users.

As such, there is a need for a means of providing furniture items that does not suffer from the drawbacks of factory assembled furniture and currently available RTA furniture kits.

SUMMARY OF THE INVENTION

The present invention is directed to a furniture item that can be entirely or partially assembled from a plurality of disassembled sub-components using a plurality of manual handled threaded fastener. The fasteners each comprise a threaded shaft that can be hand rotated by an integrated handle to pull together and retain two subcomponents. Each fastener also comprises an alignment portion for fine adjustment of the alignment of the two subcomponents. The alignment portion comprises a tapered surface adapted engage the edges of the bore hole through which the shaft is inserted if the subcomponents are misaligned to shift relative position of the subcomponents as the threaded shaft is rotated into the subcomponents.

A furniture item, according to an embodiment of the present invention, generally comprises at least one manual handled threaded fastener, a seat box and a back rest. Each manual handled threaded fastener comprises a handle, a tapered alignment portion and at least one shaft, wherein at least a portion of the shaft is threaded. The seat box further comprises at least one interface plate and also defines an interior cavity for accessing the interior face of each interface plate. The interior cavity is accessible through an opening defined in the bottom of the seat box that can be selectively closed by a flap positionable over the opening to restrict access to the interior cavity. Similarly, the back rest also further comprises an interface plate, which corresponds to the interface plate of the seat box.

During assembly, the corresponding interface plates are roughly aligned such that the corresponding bore holes bored through the plates are generally aligned. One of the hand fasteners can then be inserted through the opening in the seat box. The shaft is then inserted through the bore hole of the seat box interface plate into the corresponding bore hole of the back rest interface plate. According to an embodiment, the bore hole of the back rest interface plate is treaded to engage the threaded portion of the engaged shaft such that the rotation of the threaded portion pulls the interface plates together. As the interface plates are pulled together, the tapered alignment portion of the fastener is adapted to engage the edge of the bore hole of the seat box if the seat box and back rest are misaligned. The tapered surface of the alignment portion shifts the position of the seat box relative to the back rest as the shaft is rotated to pull the interface plates together.

According to an embodiment, the furniture item can further comprise at least one arm rest having an interface plate engagable to the seat box and the arm rest. A portion of the interface plate is engagable to one of the interface plates of the seat box. In this configuration, the back rest can further comprise at least one interface plate engagable to a portion of the arm rest interface plate. The back rest can also define an interior cavity and a closeable opening for accessing the interior face of the interface plates corresponding to the arm rests. The closeable opening can be covered by a flap that can be positioned to selectively close the opening in the back rest. As with the back rest-seat box assembly, a hand fastener can be inserted through the opening to align and affix the corresponding interface plates of the arm and back rests. According to an embodiment, the opening is proximate to the back rest interface plate corresponding to the seat box such that the seat box will cover the opening when the seat box is affixed to the back rest.

According to an embodiment, the furniture item can further comprise at least one bushing assembly corresponding to each of the hand fasteners. Each bushing assembly comprises a bushing portion defining a threaded interior for engaging the threaded portion of the shaft and sized to fit within the corresponding bore hole. The bushing portion protects the bore interface plate by preventing splitting or cracking of the interface plate caused by the threaded portion of the shaft. According to an embodiment, the bushing assembly can further comprise at least one engagement feature for gripping the interface plate to maintain the bushing portion within the bore hole.

A method of assembling a ready to assemble furniture item, according to an embodiment of the present invention, generally comprises providing a back rest and a seat box, each comprising a corresponding interface plate, wherein the seat box defines an interior cavity for accessing an inner face of the interface surface of the seat box. The method further comprises boring a first hole through seat box interface plate and a corresponding second hole through the back rest interface plate. The method also comprises providing a fastener having an shaft, an alignment portion and a handle for rotating the shaft. The method further comprises inserting the fastener through the opening into the seat box and inserting the shaft into the first and second holes of the corresponding interface plates, wherein the shaft and the second hole are threaded to engage each other. Finally, the method comprises rotating the shaft by twisting the handle to pull the corresponding interface plates together, wherein the alignment portion is adapted to engage an edge of the first hole if the seat box and back rest are misaligned and shift the seat box relative to the back rest until aligned as the interface plates are pulled together.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
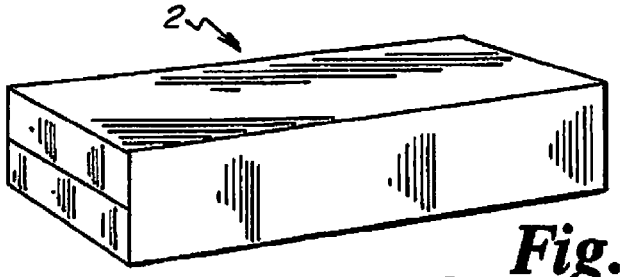
FIG. 1 is a perspective view of a packaged ready to assemble furniture kit according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 2:
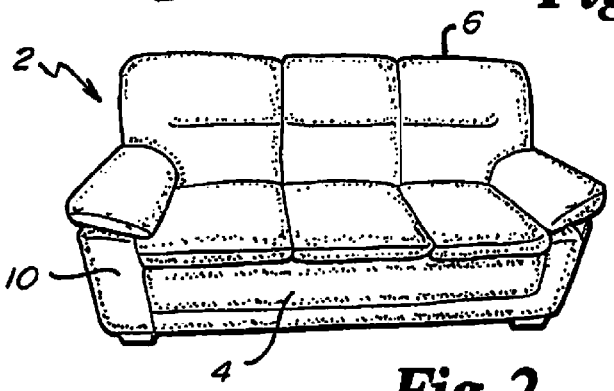
FIG. 2 is a perspective view of an assembled furniture item according to an embodiment of the present invention.
Figure 5:
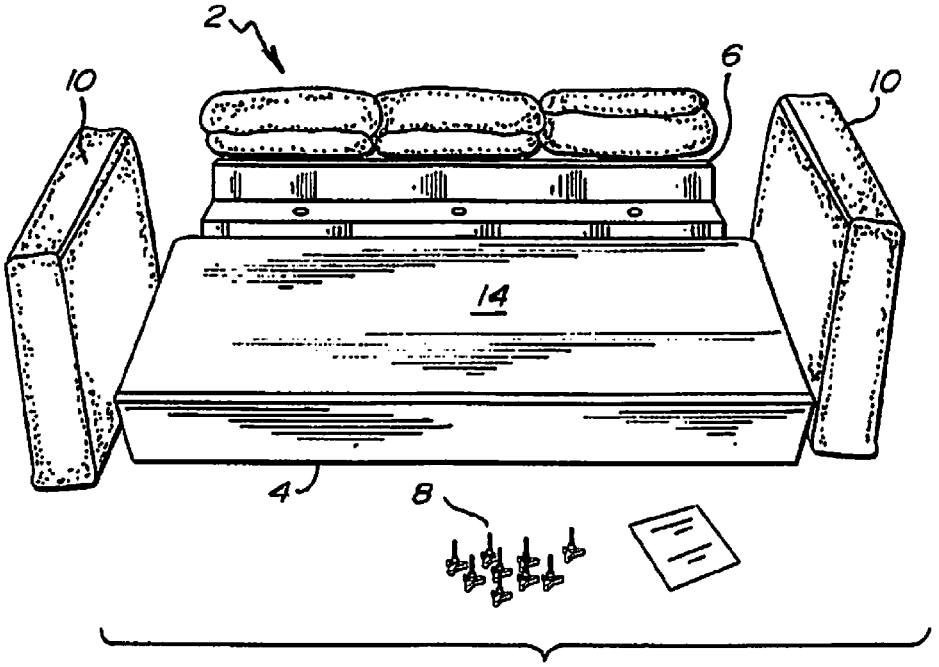
FIG. 5 is a perspective view of the ready to assemble furniture kit depicted in FIG. 1 after unpacking
Figure 6:
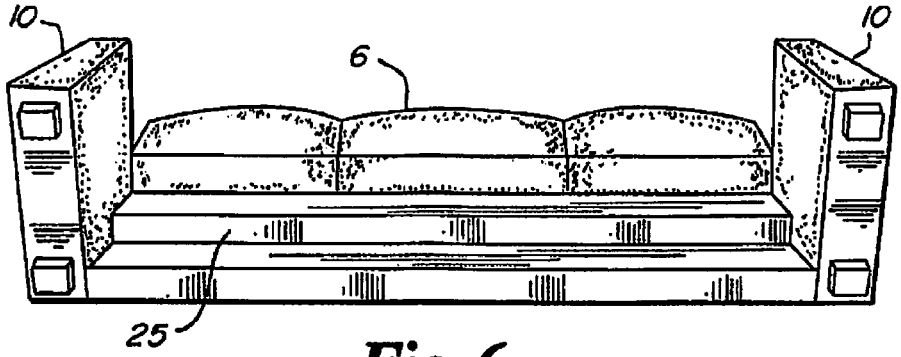
FIG. 6 is a bottom view of a furniture item according to an embodiment of the present invention after two arm rests are affixed to a back rests.
Figure 7:
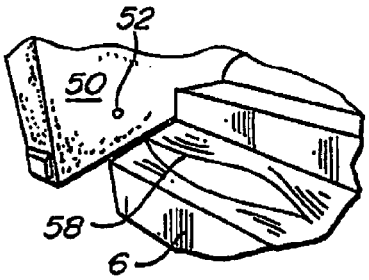
FIG. 7 is a representative perspective view illustrating an opening in a back rest for inserting a fastener into the back rest for affixing the back rest to an arm rest according to an embodiment of the present invention.
Figure 8:
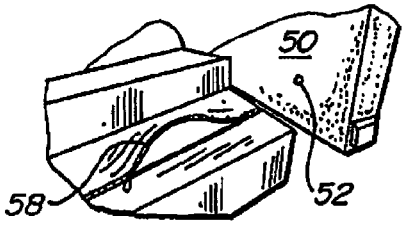
FIG. 8 is a representative perspective view illustrating an opening in a back rest for inserting a fastener into the back rest for affixing the back rest to an arm rest according to an embodiment of the present invention.

As shown in FIGS. 1-2 and 5, a furniture item 2, according to an embodiment of the present invention, can comprise a seat box 4, a back rest 6 and at least one manual handled threaded fastener 8. The furniture item 2 can also comprise at least one arm rest 10 depending on the type of furniture. As depicted, the furniture item 2 is a sofa, but can comprise any number of conventional furniture types including, for example, chaises, sectionals, love seats, chairs, benches, or recliners. Similarly, the furniture item 2 is depicted as entirely upholstered, but can comprise un-upholstered or partially upholstered furniture.

Figure 3:
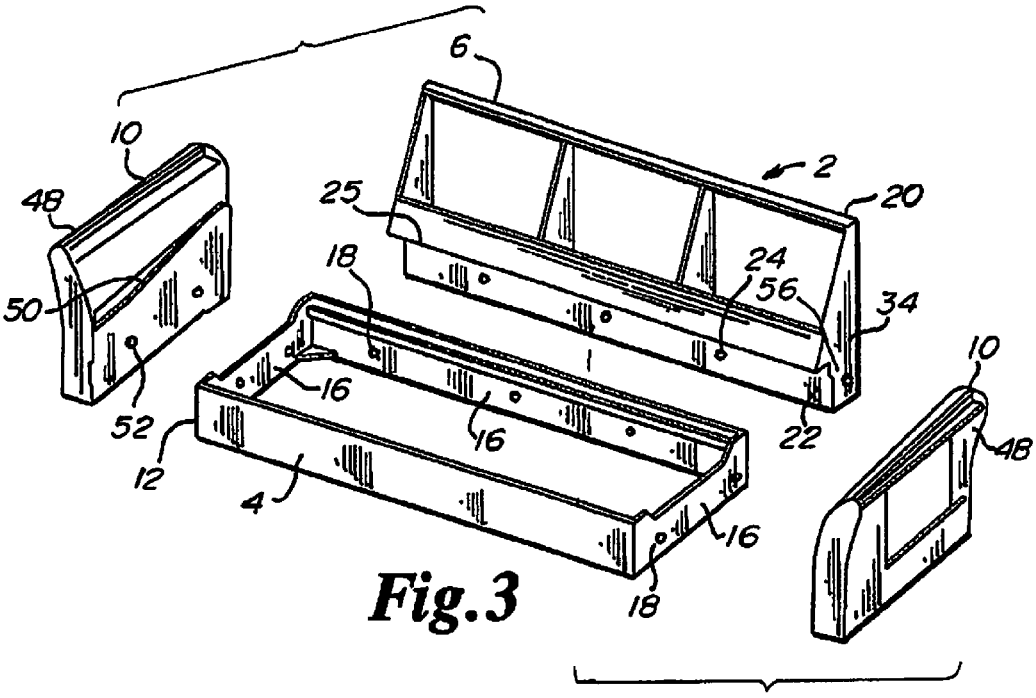
FIG. 3 is an exploded perspective view of a ready to assemble furniture item according to an embodiment of the present invention.
Figure 4:
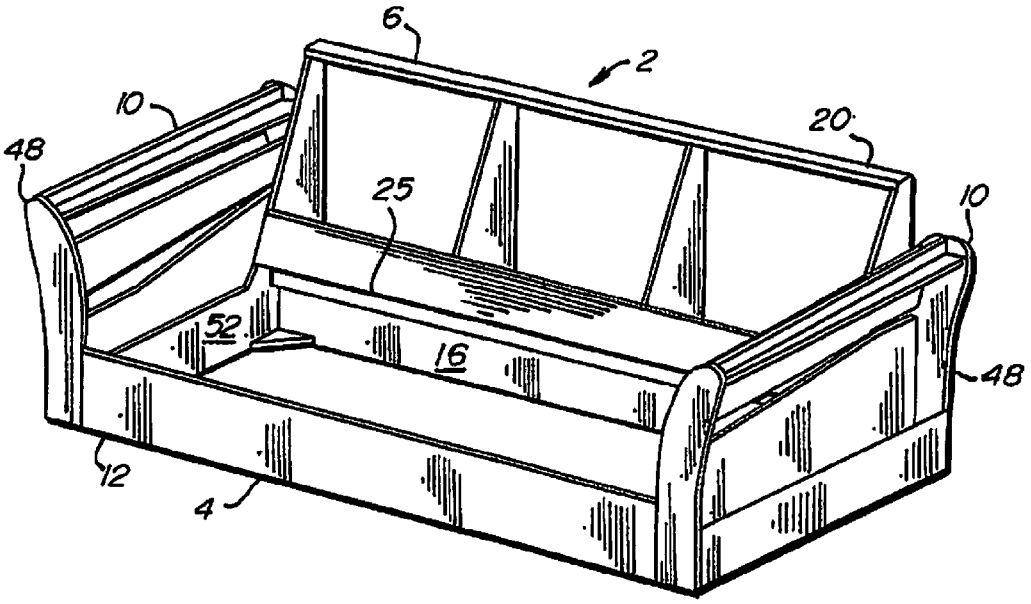
FIG. 4 is a perspective view of the furniture item depicted in FIG. 3 after assembly.
Figure 9:
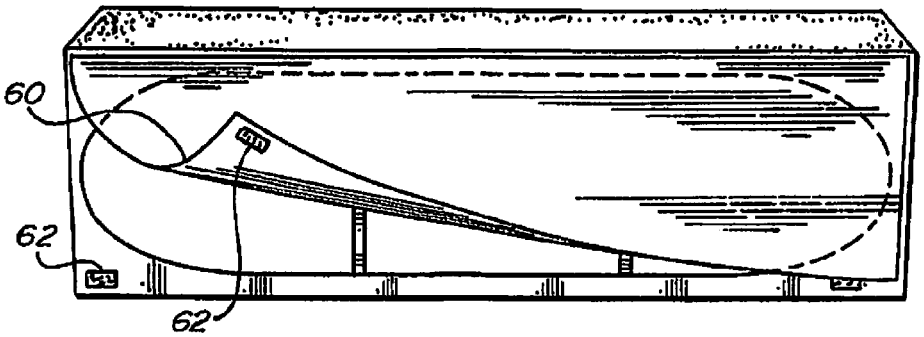
FIG. 9 is a representative bottom view of a seat box illustrating an opening in a bottom of a seat box according to an embodiment of the present invention.
Figure 10:
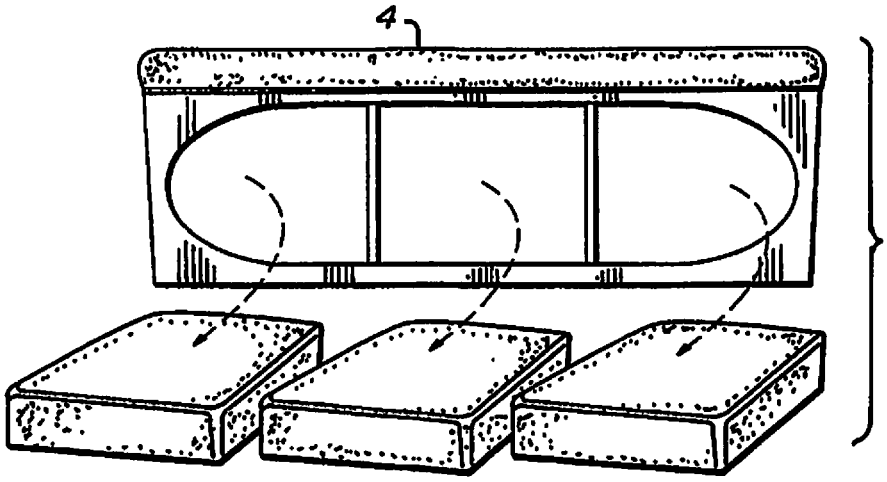
FIG. 10 is a representative bottom view of the seat box depicted in FIG. 9 and cushions that can be stored within the seat box.
Figure 11:
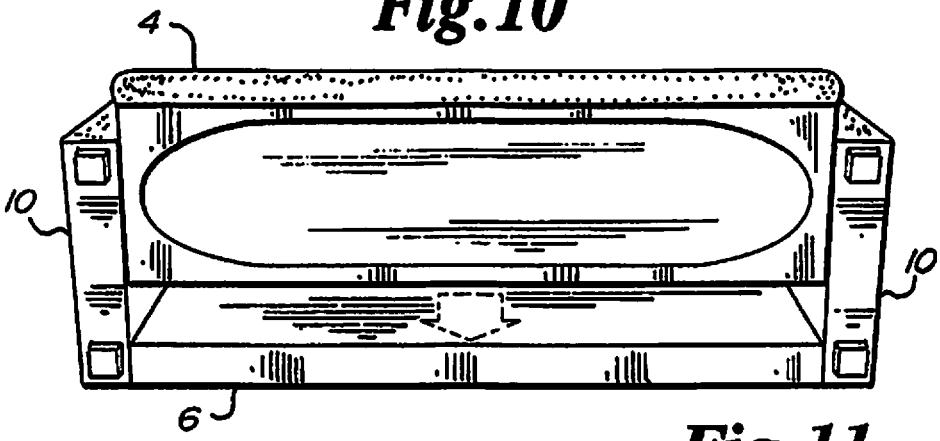
FIG. 11 is a representative bottom view of the seat box depicted in FIG. 9 being fitted to the arm rest-back rest assembly depicted in FIG. 6.
Figure 12:
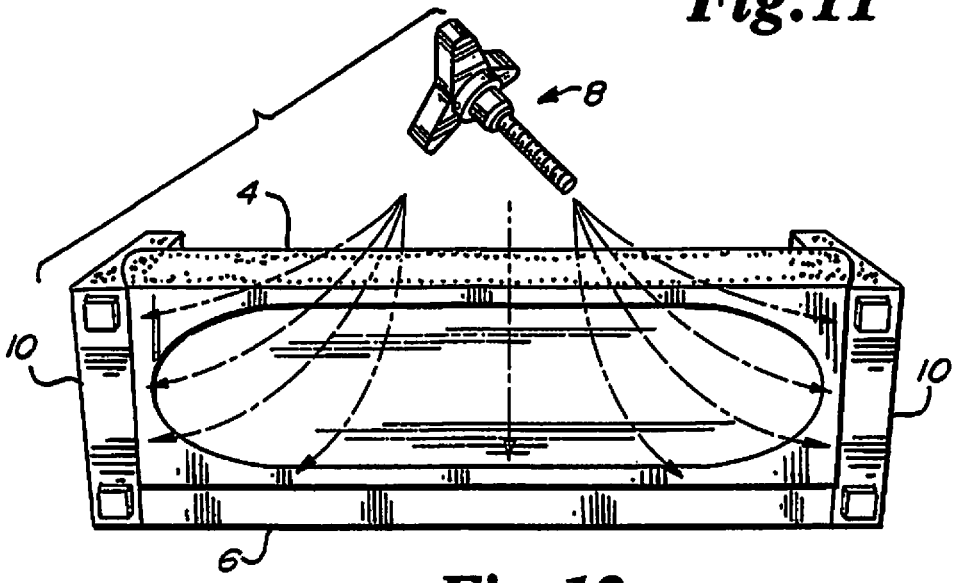
FIG. 12 is a representative bottom view of a manual handled threaded fastener according to an embodiment of the present invention and the assembled furniture item formed by fitting seat box depicted in FIG. 9 with the arm rest-back rest assembly depicted in FIG. 6.

As shown in FIGS. 3-4 and 9, the seat box 4 further comprises a rectangular frame 12 and an upper support assembly 14. The rectangular frame 12 comprises at least one interface plate 16 defining a side of the rectangular frame 12. Each interface plate 16 can comprise at least one bore hole 18 through the interface plate 16. The upper support assembly 14 is positioned over the rectangular frame 12 to create an internal cavity with the seat box 4 beneath the support assembly 14. The bottom of the seat box 4 defines an opening for accessing the internal cavity within the seat box 4.

As shown in FIGS. 3-4, the back rest 6 further comprises a support structure 20 and a seat box interface plate 22. The seat box interface plate 22 can further comprise at least one bore hole 24 corresponding to the bore hole 18. According to an embodiment, the support structure 20 can define an engagement shelf 25.

Figure 17:
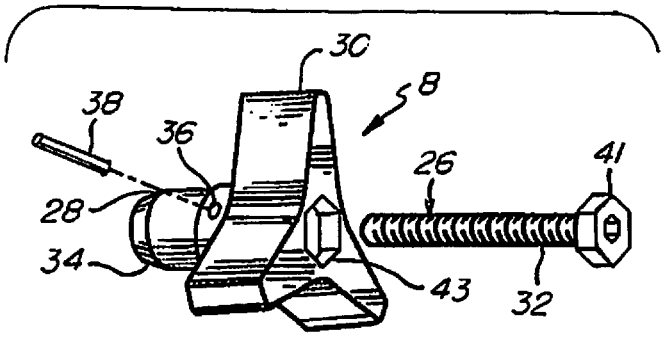
FIG. 17 is an exploded side view of a manual handled threaded fastener according to an embodiment of the present invention.
Figure 18:
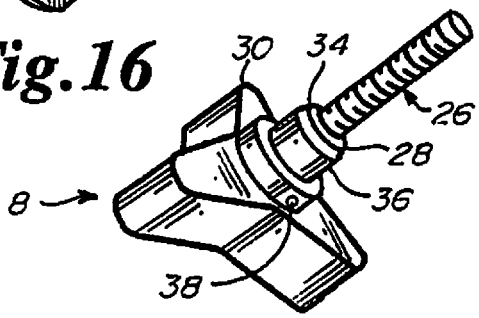
FIG. 18 is an assembled perspective view of the manual handled threaded fastener depicted in FIG. 17.

As shown in FIGS. 17-18, each fastener 8 can further comprise a shaft 26, an alignment portion 28 and a handle 30. The shaft 26 comprises a threaded portion 32 positioned proximate to the end of the shaft 26. The alignment portion 28 comprises a tapered portion 34 transitioning between the shaft 26 and an engagement portion 36. The shaft 26 comprises a smaller diameter than the engagement portion 36. According to an embodiment, a locking pin 38 is insertable through the handle 30 and the shaft 26 to lock the handle 30 to the shaft 26. According to an embodiment, the locking pin 38 can comprise a hex shape. Similarly, the shaft 26 can define a head portion 41 having a hex shape. In this configuration, the handle 30 can further define a hex shaped recess 43 for receiving the hex shaped head portion 41 of the shaft 26. According to an embodiment, the shaft 26 can have a length in the range of ½ inch to 3 inches. According to an embodiment, the shaft 26 diameter of the handle 30 can range from 1 inch to 6 inches. As depicted, the handle 30 comprises three prongs that can be gripped by the user, but can comprise any conventional handles that can be manually grasped by the user and rotated.

As shown in FIGS. 4, 19-22 the seat box 4 is affixable to the back rest 6 by aligning the seat box interface plate 22 with one of the interface plates 16 of the rectangular frame 12 such that the bore holes 18, 24 are generally aligned. The engagement shelf 25 can be engaged to the rectangular frame 12 to assist in the vertical alignment of the seat box 4 to the back rest 6. A fastener 8 can then fed be into the inter cavity of seat box 4 through the opening in the bottom of the seat box 4. The shaft 26 is inserted through the bore holes 18, 24 until the threaded portion 32 engages the bore hole 24 of the back rest 6. According to an embodiment, the bore hole 24 can be threaded to engage the threaded portion 32 of the fastener 8 such that the rotation of the fastener 8 pulls and retains the interface places 16, 22 together. The diameter of the bore hole 18 of the seat box 4 is greater than the diameter of the bore hole 24 of the back rest 6. If the seat box 4 and back rest 6 is misaligned, the tapered portion 34 of the alignment portion 28 will engage the edges of the bore hole 18 and shift the seat box 4 to correct alignment as the fastener 8 is rotated into the bore holes 18, 24. The engagement portion 36 is sized to fit the larger diameter bore hole 18 when the interface plates 16, 22 are pulled together to assist in maintaining the seat box 4 and the back rest 6 in alignment. According to an embodiment, the bore hole 18 diameter can be greater than the outer diameter of the engagement portion 36.

Figure 19:
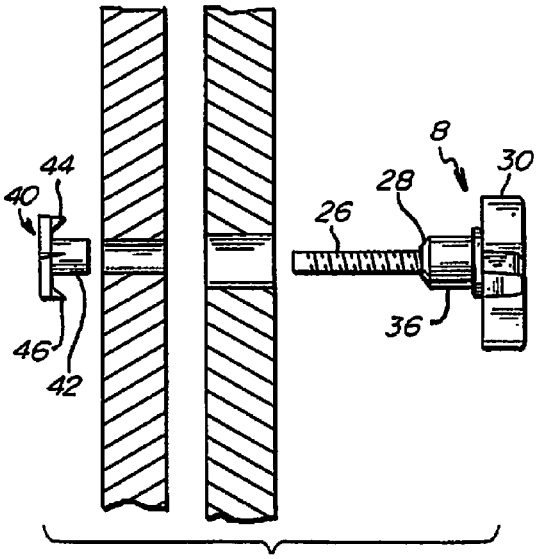
FIG. 19 is a representative cross-sectional view illustrating join two subcomponents of a furniture item together with bushing assembly depicted in FIG. 16 and the manual handled threaded fastener depicted in FIG. 18.
Figure 20:
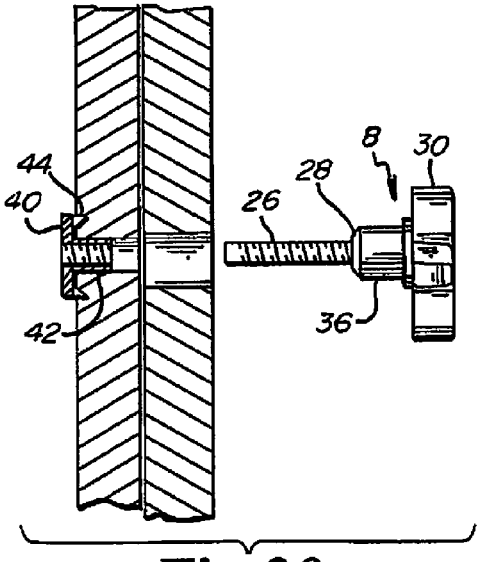
FIG. 20 is a representative cross-sectional view illustrating the insertion of the bushing assembly depicted into the bore hole of a subcomponent.
Figure 21:
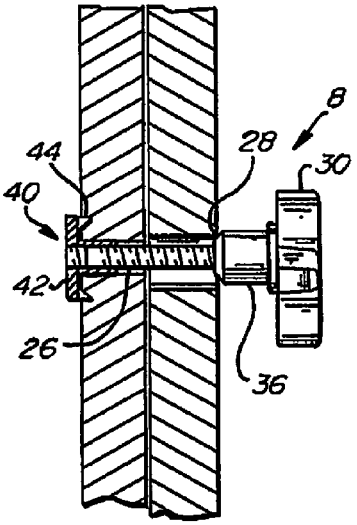
FIG. 21 is a representative cross-sectional view illustrating engagement of the bushing assembly with the threaded shaft of the fastener.
Figure 22:
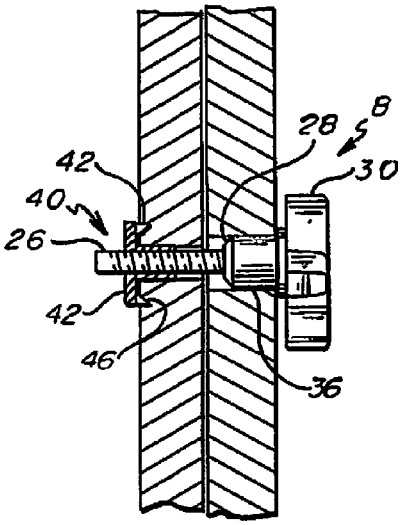
FIG. 22 is representatives cross-sectional view illustrating pulling the subcomponents by rotating the fastener within the bushing assembly.

As shown in FIG. 19, the furniture item 2 can further comprise a bushing assembly 40 having a bushing portion 42 and at least one engagement portion 44. The bushing portion 42 is sized to fit within the smaller diameter of the bore hole 24 and defines a threaded interior for engaging the threaded portion 32 of the fastener 8. As depicted, the engagement portion 44 comprises a spike 46 for engaging the interface plate 22 to maintain the bushing portion 42 within the bore hole 24. The bushing portion 42 protects the bore hole 24 and prevents cracking or splintering of the interface plate 22 due to stress from the engagement of the threaded portion 32 of the fastener 8.

As shown in FIGS. 3-4, each arm rest 10 further comprises a support structure 48 and at least one interface plate 50 having at least one bore hole 52. In this configuration, the back rest 6 further comprise at least one arm rest interface plate 54 having at least one bore hole 56 and defines an internal cavity within the back rest 6. The back rest 6 further defines an opening for accessing the internal cavity within the back rest 6 and comprises a flap 58 for selectively closing the opening. The flap 58 can be biased closed by an elastic strap or held closed by a zipper, Velcro or other conventional means of releasably closing the flap 58.

As shown in FIGS. 19-22, the arm rest 10 can be mounted to back rest 6 in same fashion as the back rest 6 is affixed to the seat box 4. A fastener 8 can be inserted through the opening in the back rest 6 and inserted through the bore holes 52, 56 until the treaded portion 32 of the shaft 26 engages the bore hole 52 to pull the interface plates 50, 54 together and secure the arm rest 10 to the back rest 6. The bore hole 56 of the back rest 6 has a greater diameter than the bore hole 52 of the arm rest 10 such that tapered portion 34 of the fastener 8 can adjust the alignment of the arm rest 10 to the back rest 6. According to an embodiment, the bushing assembly 40 can be used with the interface plate 54 to protect the interface plate 50 of the arm rest 10. According to an embodiment, the interface plate 54 can be sized to also correspond to one of the interface plates 16 of the rectangular frame 12 and engaged to the seat box 4 with a fastener 8.

As shown in FIG. 9, according to an embodiment of the present invention, the seat box 4 can further comprise a closeable flap 60 for selectively closing the opening in the bottom of the seat box 4. The closable flap 60 can be maintained in the closed by an engagement feature 62 such as a zipper, Velcro or other releasable closure means. The closeable flap 60 allows the interior cavity of the seat box 4 to be used as storage space for cushions, seating elements or other removable items of the furniture item 2.

Figure 13:
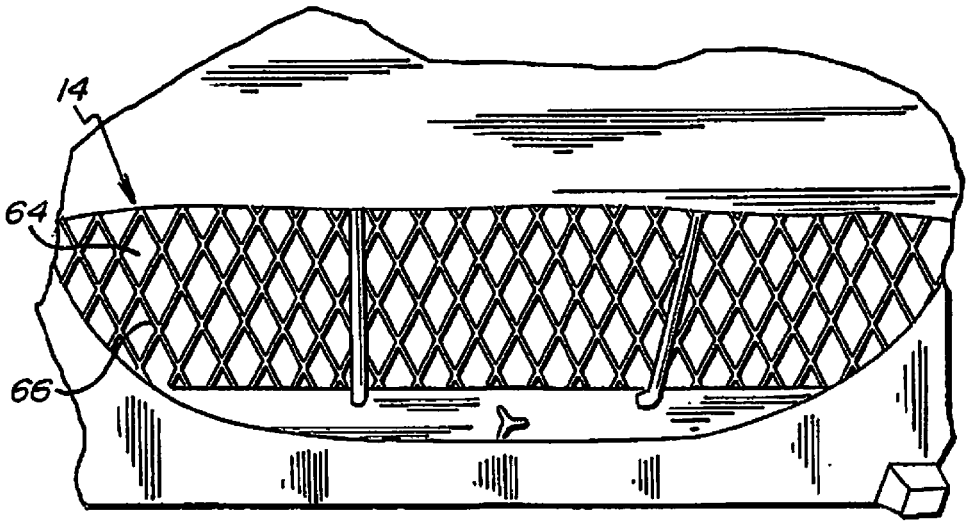
FIG. 13 is partial bottom view of a seat box according to an embodiment of the present invention.
Figure 14:
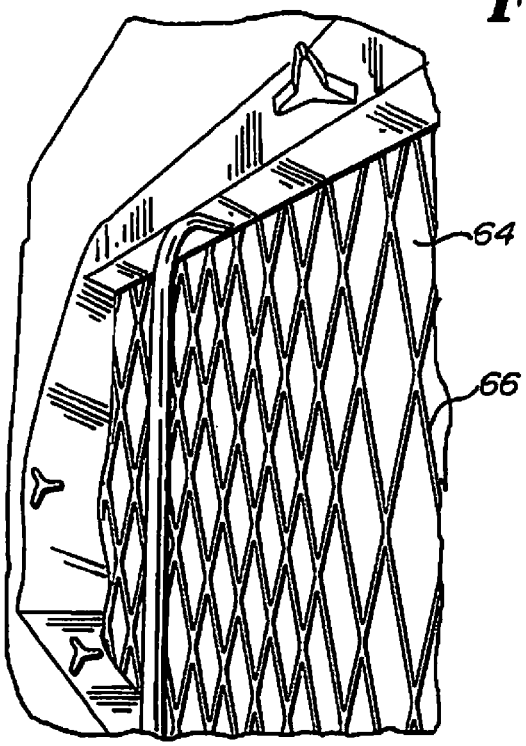
FIG. 14 is partial bottom perspective view of a seat box according to an embodiment of the present invention.
Figure 15:
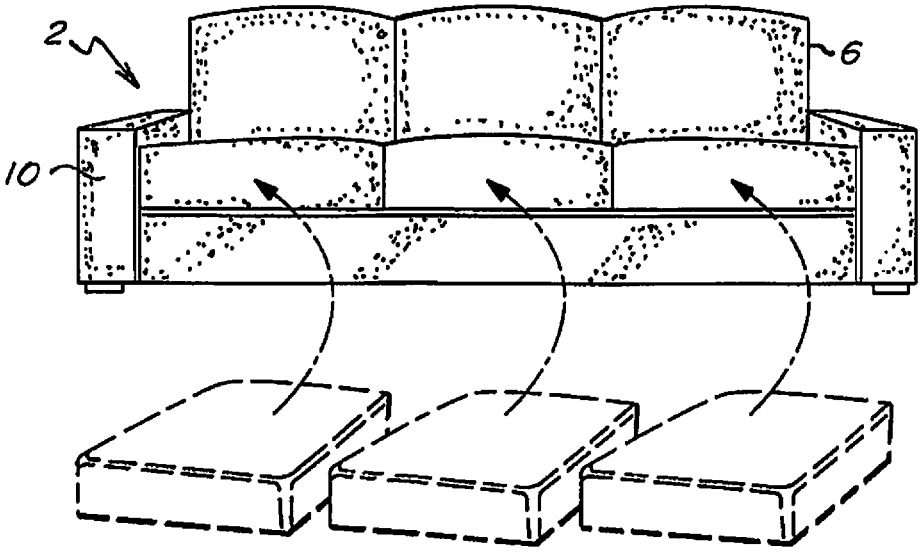
FIG. 15 is a representative perspective view illustrating the placement of the cushions on the assembled furniture item.
Figure 16:
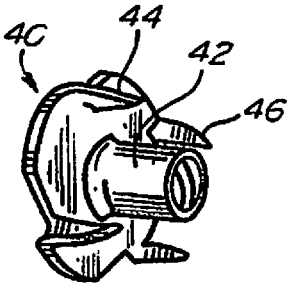
FIG. 16 is a perspective view of a bushing assembly according to an embodiment of the present invention.

As shown in FIGS. 13-14, according to an embodiment, the upper support assembly 14 can further comprise a fabric layer 64 and a support network 66. As depicted, the support network 66 comprises a plurality of interwoven metal strips, but can comprise slats or any other conventional means of support users seated on the furniture item. According to an embodiment, the upper support assembly 14 can further comprise at least one Velcro strip for engaging seat cushions or seating elements that are placed on the upper support assembly 14.

According to an embodiment, the interface plates 16, 22, 50, 54 can be covered by a fabric layer 68. The fabric layer can prevent damage to the interface surfaces and provide friction to prevent sliding of the subcomponents relative to each other.

Figure 23:
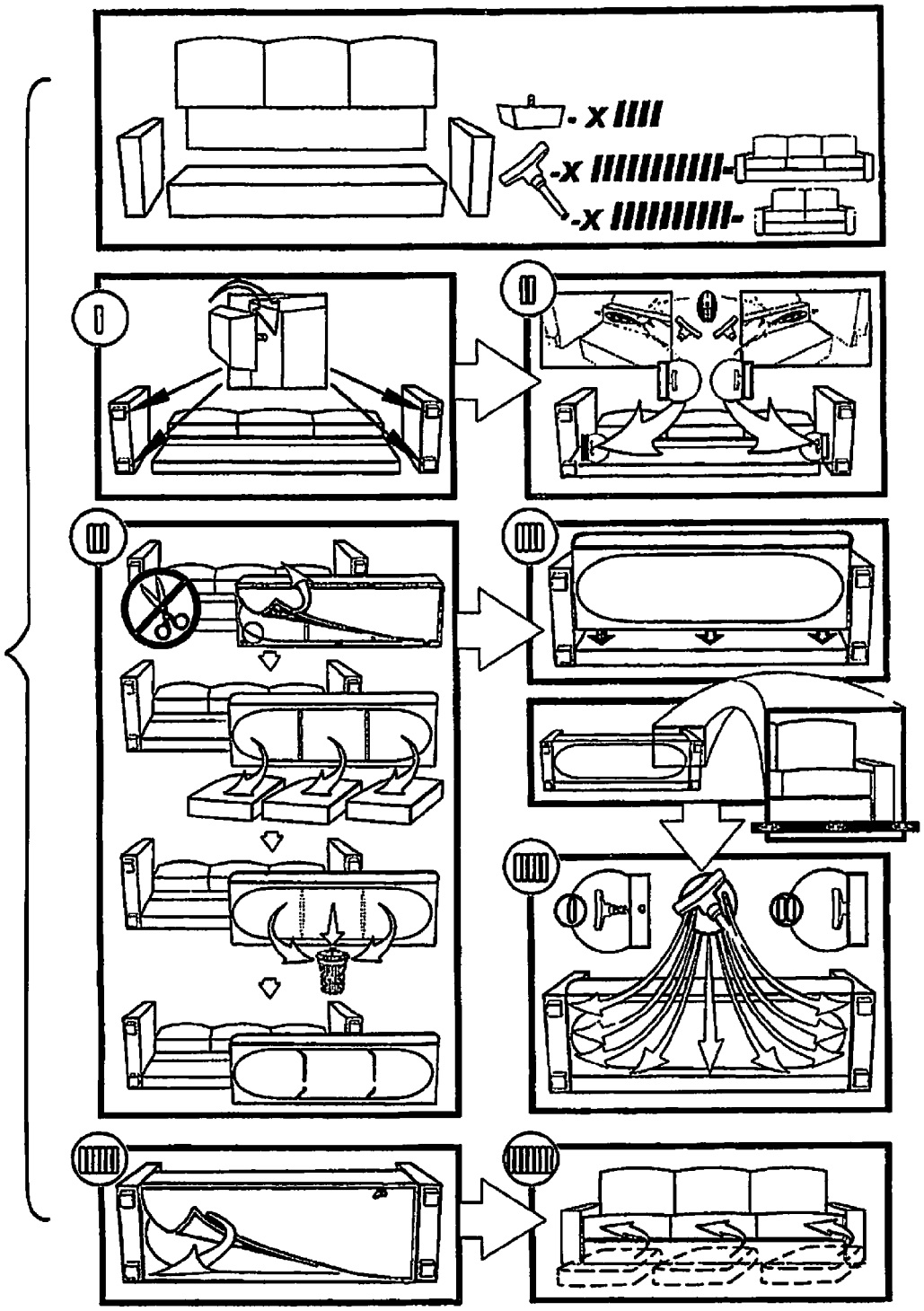
FIG. 23 is a representative view of a set of diagram instructions included with a ready to assemble furniture kit according to an embodiment of the present invention.

In FIG. 23, a representative set of instructions for assembling the furniture item 2 is depicted. The instructions provide for tool-less assembly of the furniture item 2.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A ready to assemble furniture item, comprising:

a first subcomponent having at least one first interface plate defining at least one first hole having a diameter;

a second subcomponent having a second interface plate defining at least one second hole corresponding to the at least one first hole; and a plurality of manual handled threaded fasteners each comprising a handle, an alignment portion and a shaft having a threaded portion, wherein the threaded portion of one of the plurality of manual handled threaded fasteners is insertable through the first hole and into the second hole for threaded engagement with the second subcomponent within the second hole with the threaded portion for affixing the first subcomponent to the second subcomponent; wherein the alignment portion of each of the plurality of manually handled threaded fasteners comprises an enlarged diameter portion corresponding to the diameter of the first hole and a tapered portion extending from the threaded shaft to the enlarged diameter portion whereby the tapered portion may engage an edge of the first hole to shift the first subcomponent relative to the second subcomponent to bring the first subcomponent and the second subcomponent into alignment.

2. The ready to assemble furniture item of claim 1, further comprising a set of instructions for tool-less assembly of the ready to assemble sofa item.

3. The ready to assemble furniture item of claim 1, wherein the first subcomponent further comprises an upper support assembly positioned on a rectangular frame to define an interior cavity, wherein the at least one first interface plate defines at least one wall of the rectangular frame.

4. The ready to assemble furniture item of claim 3, wherein the first subcomponent defines an opening in the bottom of the first subcomponent for accessing the interior cavity of the first subcomponent such that the shaft of the fastener can be inserted through the first hole from within the interior cavity of the first subcomponent.

5. The ready to assemble furniture item of claim 1, wherein the second interface plate comprises a bushing assembly within the second hole having a bushing portion defining a threaded interior for engaging the threaded portion.

6. The ready to assemble furniture item of claim 5, wherein the bushing assembly further comprises at least one engagement feature affixable to the second interface plate to maintain the bushing portion within the second hole.

7. A ready to assemble furniture item kit comprising:

a plurality of packaged subcomponents including: a first subcomponent having at least one first interface plate defining at least one first hole; a second subcomponent having a second interface plate defining at least one second hole corresponding to the at least one first hole having a diameter; and a plurality of threaded fasteners each comprising a handle, an alignment portion and a shaft having a threaded portion, wherein the threaded portion of one of the plurality of threaded fasteners is insertable through the first hole and into the second hole for engagement within the second hole with the threaded portion to affix the first subcomponent to the second subcomponent; wherein the alignment portion of each of the plurality of threaded fasteners comprises an enlarged diameter portion and a tapered portion, and wherein the enlarged diameter portion corresponds to the diameter of the first hole and the tapered portion extends from the enlarged diameter portion to the threaded shaft whereby the tapered portion may engage an edge of the first hole to shift the first subcomponent relative to the second subcomponent to bring the first subcomponent and the second subcomponent into alignment.

8. The ready to assemble furniture item kit of claim 7, wherein the first subcomponent further comprises a flap having a releasable closure mechanism for selectively covering the opening in the bottom of the first subcomponent.

9. The ready to assemble furniture item kit of claim 7, further comprising a box containing the packaged subcomponents and a set of instructions for tool-less assembly of the ready to assemble furniture item kit.

10. The ready to assemble furniture item kit of claim 7, wherein the first subcomponent further comprises an upper support assembly positioned on a rectangular frame to define an interior cavity within the first subcomponent, wherein the at least one first interface plate defines at least one wall of the rectangular frame.

11. The ready to assemble furniture item kit of claim 10, wherein the first subcomponent defines an opening for accessing the interior cavity of the first subcomponent such that the shaft of the fastener can be inserted through the first hole from within the interior cavity of the first subcomponent.

12. The ready to assemble furniture item kit of claim 7, wherein the second interface plate comprises a bushing assembly within the second hole having a bushing portion defining a threaded interior for engaging the threaded portion.

13. The ready to assemble furniture item kit of claim 12, wherein the bushing assembly further comprises at least one engagement feature affixable to the second interface plate to maintain the bushing portion within the second hole.

14. A method of assembling a ready to assemble furniture item, comprising: providing a ready to assemble furniture item kit having: a first subcomponent having at least one first interface plate defining at least one first hole, a back rest having a second interface plate defining at least one second hole corresponding to the at least one first hole, wherein the first hole comprises a larger diameter than the second hole, and a plurality of screwed fasteners each comprising a handle, an alignment portion and a shaft having a threaded portion, wherein the alignment portion of each of the plurality of screwed fasteners comprises an enlarged diameter portion and a tapered portion leading to the shaft; positioning the first subcomponent and back rest such that the first and second interface plates are proximate to each other and the first and second holes are in alignment; inserting the shaft of at least one of the plurality of fasteners through the first and second holes until the threaded portion of the shaft engages the second hole; rotating the shaft by twisting the handle to pull the first and second interface surfaces together and affixing the first subcomponent to the back rest; and engaging an edge of the first hole with the tapered surface of the alignment portion for shifting the position of the first subcomponent relative to the back rest to correct any misalignment between the first subcomponent and the back rest.

15. The method of claim 14, wherein the first subcomponent further comprises an upper support assembly positioned on a rectangular frame to define an interior cavity within the first subcomponent, wherein the first subcomponent also defines an opening in the bottom of the first subcomponent for accessing the interior cavity, wherein the at least one first interface plate defines at least one wall of the rectangular frame.

16. The method of claim 15, further comprising: navigating the at least one fastener through the opening in the first subcomponent to position the fastener within the interior cavity defined by the first subcomponent for insertion into the first and second holes.

17. The method of claim 14, further comprising: providing a third subcomponent comprising a third interface plate defining at least one third hole; wherein the first subcomponent further comprises a fourth interface plate defining a fourth hole, wherein one of the plurality of fasteners is insertable through the fourth and third holes to engage the third hole with the threaded portion of the shaft to affix and align the first subcomponent to the third sub component.

18. The method of claim 17, further comprising: positioning the first subcomponent and third subcomponent such that the third and fourth interface plates proximate to each other and the fourth and third hole are in proximate alignment; inserting the shaft of at least one of the plurality of fasteners through the fourth and third hole until the threaded portion of the shaft engages the third hole; rotating the shaft by twisting the handle to pull the third and fourth interface surfaces together and affix the first subcomponent to the third subcomponent; and engaging an edge of the fourth hole with the tapered surface of the alignment portion to shift the position of the third subcomponent relative to the first subcomponent to correct any misalignment between the third subcomponent and first subcomponent.

* * * * *